US008305330B2

(12) United States Patent
Fang et al.

(10) Patent No.: US 8,305,330 B2
(45) Date of Patent: Nov. 6, 2012

(54) GATE DRIVING CIRCUIT OF DISPLAY PANEL INCLUDING SHIFT REGISTER SETS

(75) Inventors: Yu-Chieh Fang, Kaohsiung (TW); Liang-Hua Yeh, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 339 days.

(21) Appl. No.: 12/582,716

(22) Filed: Oct. 21, 2009

(65) Prior Publication Data

US 2011/0025658 A1 Feb. 3, 2011

(30) Foreign Application Priority Data

Aug. 3, 2009 (TW) ..... 98214313 U

(51) Int. Cl.
*G09G 3/36* (2006.01)

(52) U.S. Cl. ..... 345/100

(58) Field of Classification Search ..... 345/87, 345/90, 94, 98, 100, 208
See application file for complete search history.

(56) References Cited

U.S. PATENT DOCUMENTS

| | | | | |
|---|---|---|---|---|
| 6,348,906 | B1 * | 2/2002 | Dawson et al. | 345/82 |
| 2005/0078100 | A1 * | 4/2005 | Tsujino et al. | 345/204 |
| 2008/0136756 | A1 * | 6/2008 | Yeo et al. | 345/87 |
| 2011/0025658 | A1 * | 2/2011 | Fang et al. | 345/205 |

FOREIGN PATENT DOCUMENTS

| | | |
|---|---|---|
| TW | 200818086 | 4/2008 |
| TW | I298865 | 7/2008 |

* cited by examiner

*Primary Examiner* — Chanh Nguyen
*Assistant Examiner* — Ram Mistry
(74) *Attorney, Agent, or Firm* — Jianq Chyun IP Office

(57) ABSTRACT

A gate driving circuit of a display panel including a plurality of shift register sets coupled in series is provided. Every shift register set includes a shift register unit and a transistor coupled therewith. The shift register units receive a gate timing signal and an inverted gate timing signal, and one of a first level shift register unit and a last level shift register unit further receives a threshold driving signal. The shift register units respectively output a plurality of gate driving signals sequentially according to the threshold driving signal, the gate timing signal and the inverted gate timing signal. A gate and a first source/drain of each transistor are coupled to receive a gate controlling signal, and a second source/drain of each transistor is coupled to the corresponding shift register unit to output one of the gate driving signals.

4 Claims, 7 Drawing Sheets

200

GATE DRIVING CIRCUIT OF DISPLAY PANEL INCLUDING SHIFT REGISTER SETS

CROSS-REFERENCE TO RELATED APPLICATION

This application claims the priority benefit of Taiwan application serial no. 98214313, filed on Aug. 3, 2009. The entirety of the above-mentioned patent application is hereby incorporated by reference herein and made a part of specification.

BACKGROUND OF THE INVENTION

1. Field of Invention

The invention relates to a gate driving circuit of a display panel, and more particularly, to a gate driving circuit of a display panel with the gate driving circuit adopted in gate in panel (GIP).

2. Description of Related Art

In recent years, along with development in semiconductor technology, portable electronic products and flat display products have become increasingly popular. In various types of flat displays, liquid crystal displays (LCDs) have gradually become the main stream of display products due to features such as low voltage operation, radiation-free scattering, light weight, compactness, and the like.

In order to reduce the manufacturing cost of LCDs, some manufacturers have proposed to manufacture multi-level shift registers directly on glass substrates by adopting thin film transistors (TFTs), thereby replacing conventional gate driving chips for reducing the manufacturing cost of LCDs.

FIG. 1A is a schematic block diagram illustrating a conventional multi-level shift register directly manufactured on a glass substrate. Referring to FIG. 1A, a plurality of shift registers $SR_1'$, $SR_2'$, $SR_3'$, . . . , $SR_{n-2}'$, $SR_{n-1}'$, $SR_n'$ are serially coupled to one another. The shift registers $SR_1'$, $SR_2'$, $SR_3'$, . . . , $SR_{n-2}'$, $SR_{n-1}'$, $SR_n'$ are flip-flops respectively, and therefore each include two outputs. One of the two outputs (marked as $C_{out}'$ in the figure) is used as a Set input of a next level shift register. Here, the Set input is marked as S in FIG. 1A. Moreover, the other output outputs gate driving signals $Gout_1'$, $Gout_2'$, $Gout_3'$, . . . , $Gout_{n-2}'$, $Gout_{n-1}'$, $Gout_n$ and is used as a Reset input of a previous level shift register. Here, the Reset input is marked as R in FIG. 1A.

FIG. 1B is an equivalent circuit diagram of a single level shift register set in FIG. 1A. Referring to FIG. 1A and FIG. 1B simultaneously, the shift register sets $SR_1'$, $SR_2'$, $SR_3'$, . . . , $SR_{n-2}'$, $SR_{n-1}'$, $SR_n'$ respectively receive a gate timing signal CKV, an inverse of the gate timing signal CKVB, and a reference voltage VGL, and the first level shift register $SR_1'$ further receives a threshold driving signal STVP. Therefore, the shift registers $SR_1'$, $SR_2'$, $SR_3'$, . . . , $SR_{n-2}'$, $SR_{n-1}'$, $SR_n'$ respectively output a plurality of gate driving signals $Gout_1'$, $Gout_2'$, $Gout_3'$, . . . , $Gout_{n-2}'$, $Gout_{n-1}'$, $Gout_n'$ sequentially according to the threshold driving signal STVP, the gate timing signal CKV, and the inverted gate timing signal CKVB, so as to drive scan lines in the display panel in sequence.

However, when the display is being turned off, every pixel in the display discharges. Since the speed of discharging each pixel is different, the display frame becomes irregular, and this phenomenon is generally referred as image sticking.

SUMMARY OF THE INVENTION

The invention is directed to a gate driving circuit of a display panel, where the gate driving circuit is capable of eliminating an occurrence of an image sticking phenomenon when the display panel is turned off.

The invention is directed to a gate driving circuit of a display panel. The gate driving circuit includes a plurality of shift register sets, and each shift register set includes a shift register unit and a transistor. The shift register units are serially coupled to one another and each transistor is coupled to the corresponding shift register unit. Moreover, the shift register units receive a gate timing signal and an inverted gate timing signal. One of a first level shift register unit and a last level shift register unit further receives a threshold driving signal. The shift register units respectively output a plurality of gate driving signals sequentially according to the threshold driving signal, the gate timing signal, and the inverted gate timing signal. On the other hand, a gate and a first source/drain of each transistor are coupled to receive a gate controlling signal, and a second source/drain of each transistor is coupled to the corresponding shift register unit to output one of the gate driving signals.

According to an embodiment of the invention, when the display panel has stopped displaying, the gate controlling signal is a pulse signal, so that the gates correspondingly connected to the shift register units in the gate driving circuit of the display panel are conducted simultaneously according to this pulse signal.

According to an embodiment of the invention, the gate driving circuit of the display panel further includes a plurality of level shift units. The level shift units are coupled to the shift register sets respectively and receive an output enable signal, a timing signal, a threshold signal, and a controlling signal. Moreover, each level shift unit converts a voltage level of the timing signal to output the gate timing signal and the inverted gate timing signal, converts a voltage level of the threshold signal to output the threshold driving signal, and converts a voltage level of the controlling signal to output the gate controlling signal. In one embodiment, the gate driving circuit of the display panel further includes a plurality of adjustment units. The adjustment units are serially connected between paths of the level shift units coupling to the shift register sets respectively. In one embodiment, each adjustment unit includes a plurality of switch sets. The switch sets receive the threshold driving signal, the gate timing signal, and the inverted gate timing signal. In addition, each switch set includes a first switch and a second switch. The first switch is serially connected between the corresponding level shift unit and the corresponding shift register set. The second switch is serially connected between a reference voltage, the corresponding level shift unit, and the corresponding shift register set. Here, the first switch and the second switch have opposite disenable/enable actions.

According to an embodiment of the invention, the gate driving circuit of the display panel further includes a plurality of inverters coupled to the level shift units respectively. Furthermore, each inverter receives an inverted controlling signal and outputs the controlling signal accordingly.

According to an embodiment of the invention, the inverted gate timing signal is an inverse of the gate timing signal.

In light of the foregoing, every shift register set in the gate driving circuit of the display panel in the present invention is constituted by coupling a transistor and a shift register unit. As a consequence, a controlling signal is received through this transistor to eliminate image sticking.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
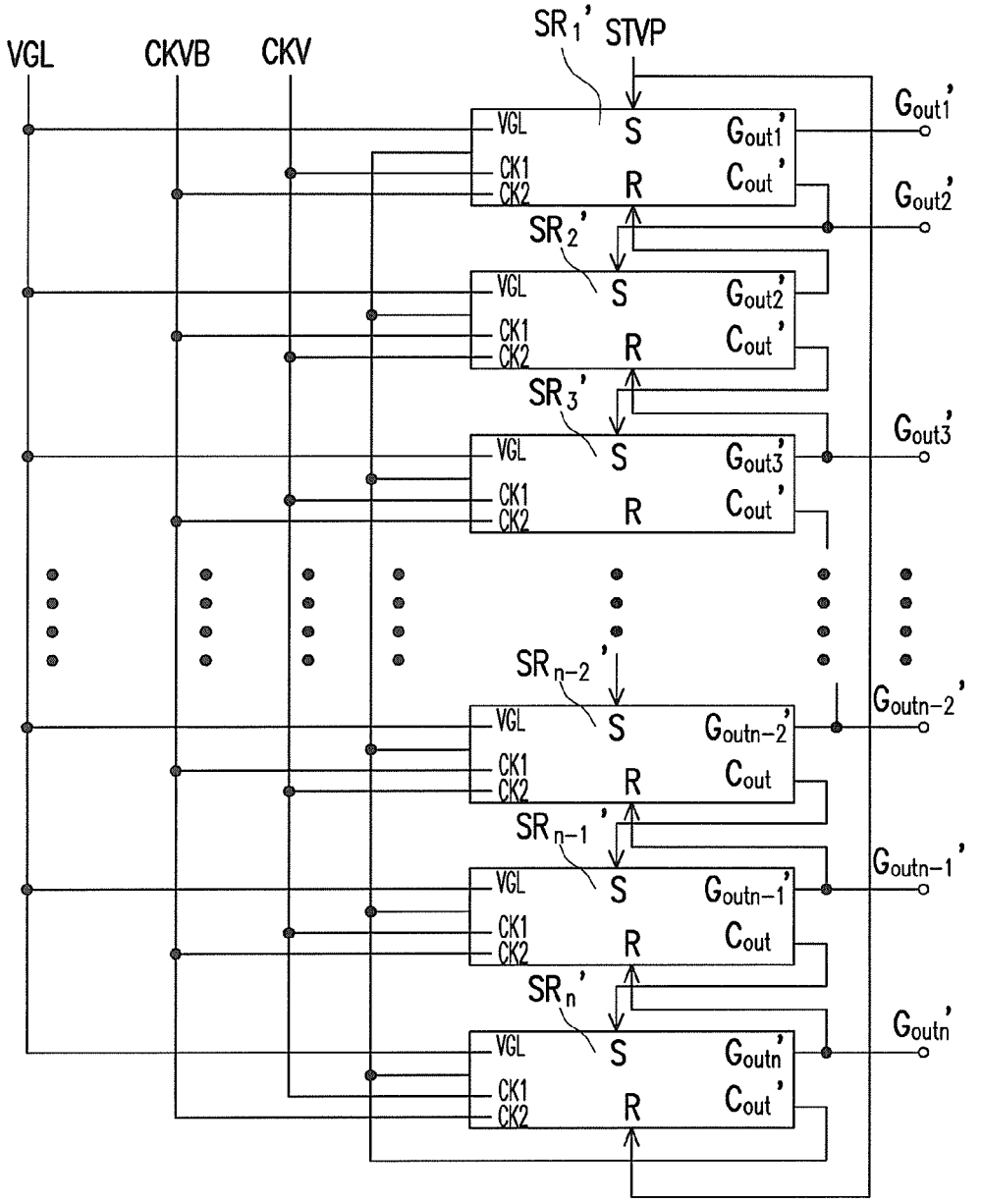
FIG. 1A (PRIOR ART)
FIG. 1A is a schematic block diagram illustrating a conventional multi-level shift register directly manufactured on a glass substrate.
Figure 1B:
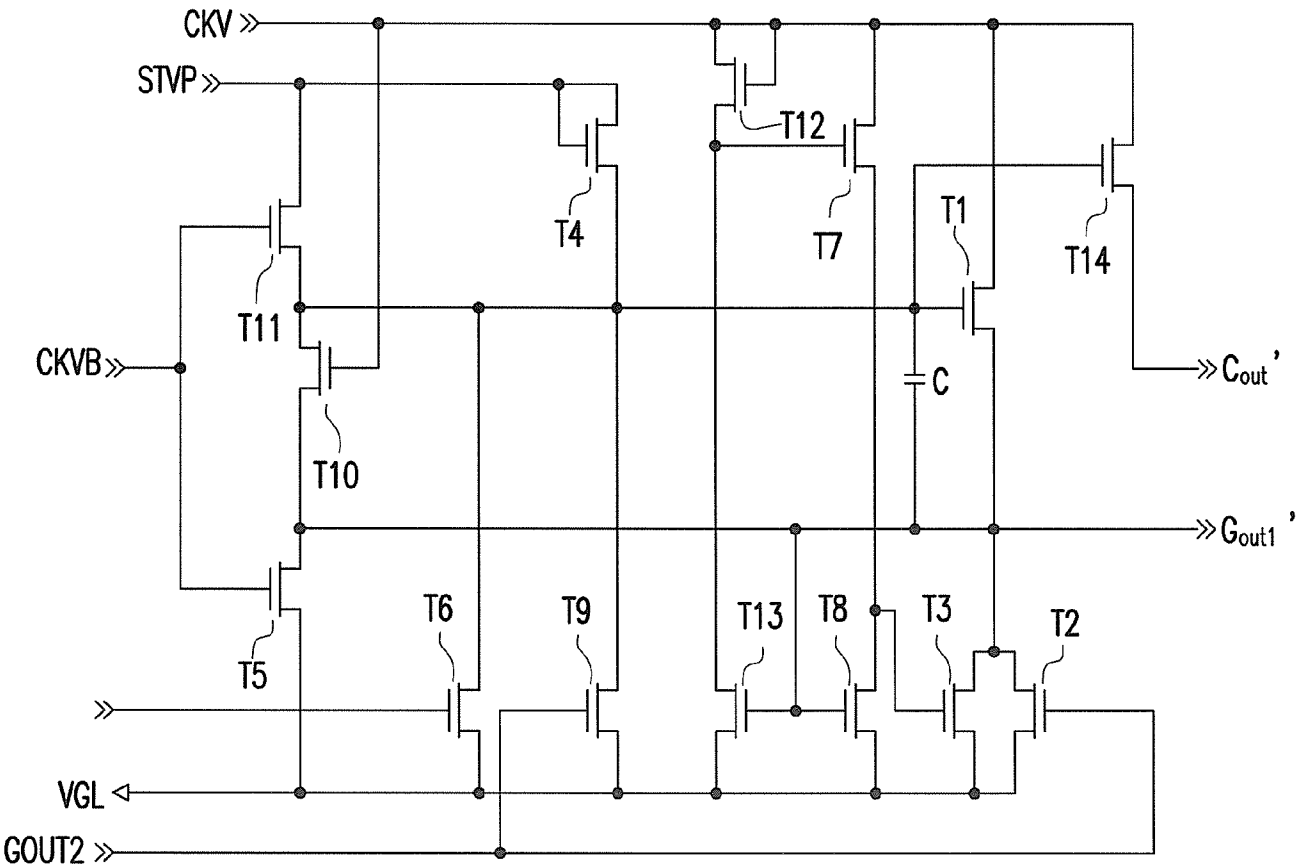
FIG. 1B (PRIOR ART)
FIG. 1B is an equivalent circuit diagram of a single level shift register set in FIG. 1A.
Figure 2A:
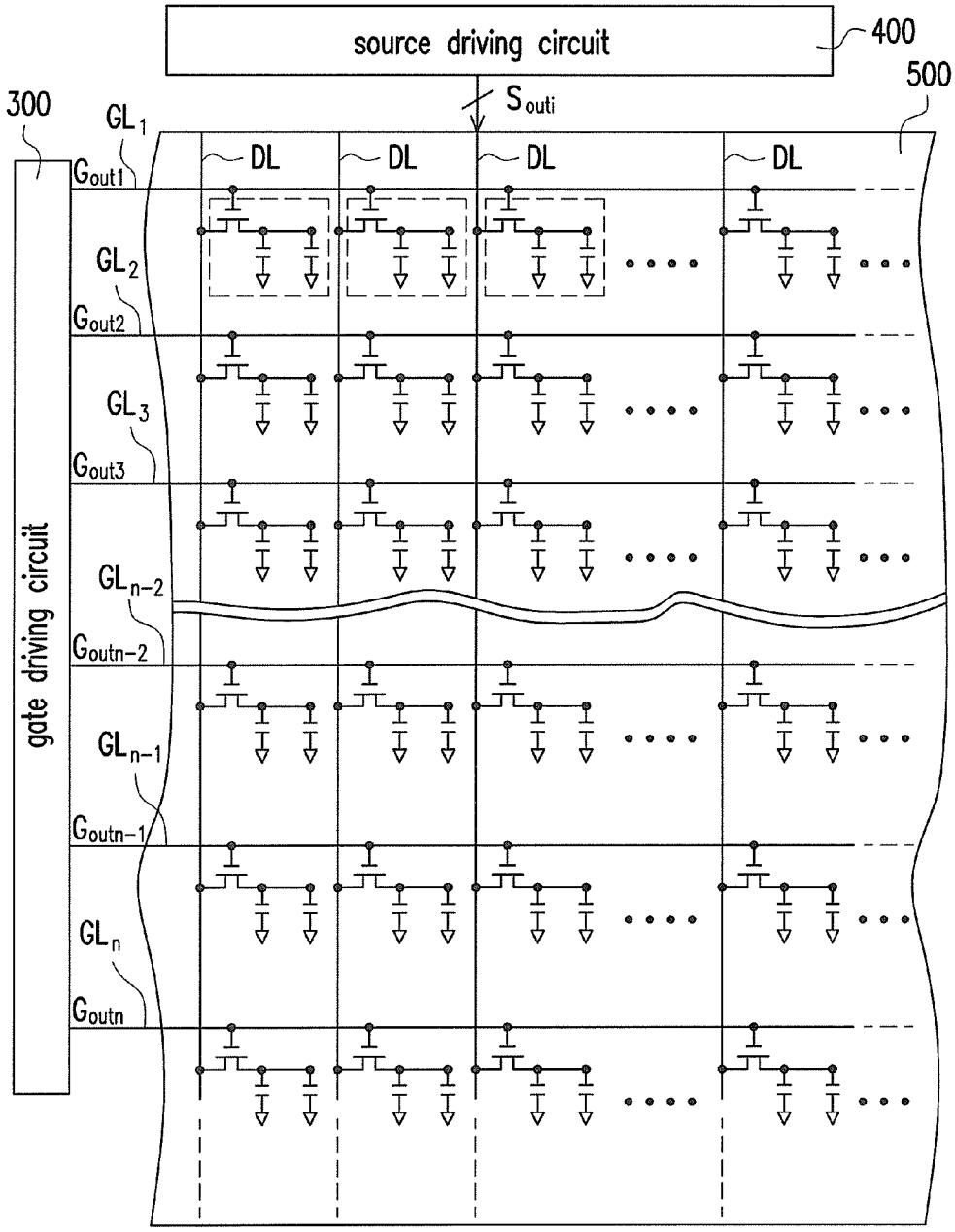
FIG. 2A schematically shows a partial top view of a display according to an embodiment of the invention.

FIG. 2A schematically shows a partial top view of a display according to an embodiment of the invention. Referring to FIG. 2A, a display panel 200 of the present embodiment includes a gate driving circuit 300, a source driving circuit 400, a plurality of scan lines $GL_1$, $GL_2$, $GL_3$, . . . , $GL_{n-2}$, $GL_{n-1}$, $GL_n$ parallel to one another, a plurality of data lines DL parallel to one another, and a pixel array 500. Practically, the gate driving circuit 300, the source driving circuit 400, the scan lines $GL_1$, $GL_2$, $GL_3$, . . . , $GL_{n-2}$, $GL_{n-1}$, $GL_n$ the data lines DL, and the pixel array 500 are disposed on a substrate. The substrate in the present embodiment is a glass substrate, for example; however, the invention is not limited thereto.

In the present embodiment, the pixel array 500 includes a plurality of pixel regions P defined by the scan lines $GL_1$, $GL_2$, $GL_3$, . . . , $GL_{n-2}$, $GL_{n-1}$, $GL_n$ crossing the data lines DL. In addition, in each pixel region P, a transistor electrically connects with the corresponding scan line and data line, and a capacitance is configured to represent an equivalent capacitance value of that pixel region P. Obviously, the display panel 200 of the present embodiment further selectively includes other components and FIG. 2A merely shows relevant components for the convenience of illustration in the following embodiments.

In the present embodiment, the pixel array 500 receives a plurality of gate driving signals $Gout_1$, $Gout_2$, $Gout_3$, . . . , $Gout_{n-2}$, $Gout_{n-1}$, $Gout_n$ outputted by the gate driving circuit 300 through the scan lines $GL_1$, $GL_2$, $GL_3$, . . . , $GL_{n-2}$, $GL_{n-1}$, $GL_n$ and receives source driving signals $Sout_i$ outputted by the source driving circuit 400 through the data lines DL.

Practically, the source driving circuit 400 further drives the pixel array 500 through the bonding between source driving chip(s) (not shown) and chip bonding pad(s) on the glass substrate. However, the invention is not limited thereto.

It should be noted that in the present embodiment, a multi-level shift register set (to be illustrated in detail later) is manufactured directly on the glass substrate by adopting a thin film transistor, thereby replacing the conventional gate driving chip. Such display panel 200 is referred as gate in panel (GIP in short), and this design is capable of reducing the manufacturing cost of the display panel 200.

Figure 2B:
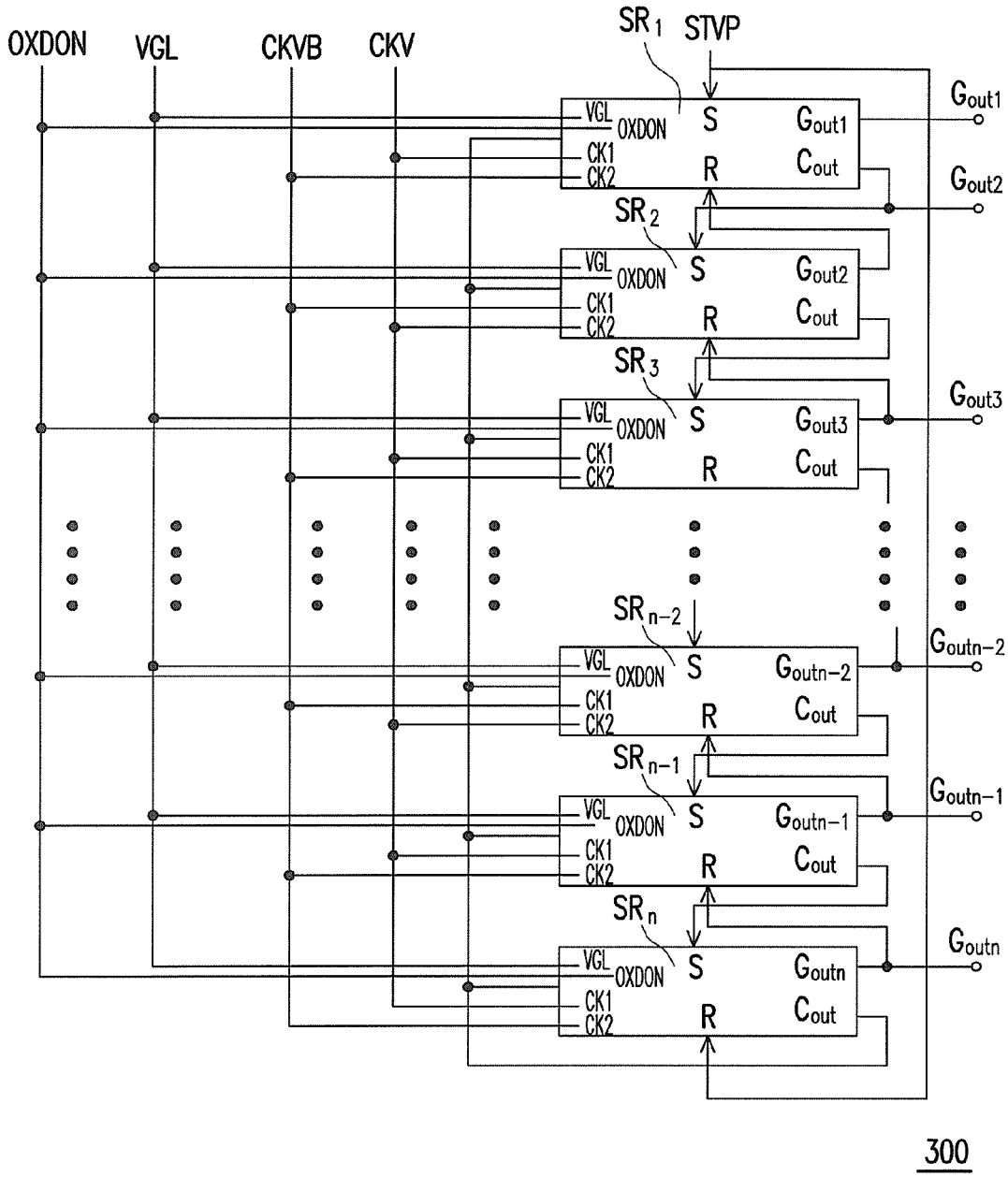
FIG. 2B is a schematic block diagram of a gate driving circuit of a display panel in FIG. 2A.

In details, referring to FIG. 2B, FIG. 2B is a schematic block diagram of the gate driving circuit of the display panel in FIG. 2A. The gate driving circuit 300 of the display panel 200 in the present embodiment includes a plurality of shift register sets $SR_1$, $SR_2$, $SR_3$, . . . , $SR_{n-2}$, $SR_{n-1}$, $SR_n$ that are serially coupled to one another.

In the present embodiment, the shift register sets $SR_1$, $SR_2$, $SR_3$, . . . , $SR_{n-2}$, $SR_{n-1}$, $SR_n$, for example, are SR flip-flops respectively, and therefore each includes two outputs. One of the two outputs (marked as $C_{out}$ in the figure) is used as a Set input of a next level shift register set. Here, the Set input is marked as S in FIG. 2B. Moreover, the other output outputs the gate driving signals $Gout_1$, $Gout_2$, $Gout_3$, . . . , $Gout_{n-2}$, $Gout_{n-1}$, $Gout_n$ and is used as a Reset input of a previous level shift register set. Here, the Reset input is marked as R in FIG. 2B.

The shift register sets $SR_1$, $SR_2$, $SR_3$, . . . , $SR_{n-2}$, $SR_{n-1}$, $SR_n$ of the present embodiment receive a gate timing signal CKV, an inverted gate timing signal CKVB, and a reference voltage VGL respectively. Here, the inverted gate timing signal CKVB is an inverse of the gate timing signal CKV, for instance. Specifically, in the present embodiment, CK1 inputs of odd-numbered shift register sets $SR_1$, $SR_3$, . . . , $SR_{n-2}$, $SR_n$ receive the gate timing signal CKV respectively and CK2 inputs thereof receive the inverted gate timing signal CKVB respectively. On the other hand, CK1 inputs of even-numbered shift register sets $SR_2$, . . . , $SR_{n-1}$ receive the inverted gate timing signal CKVB respectively and CK2 inputs thereof receive gate timing signal CKV respectively.

In the present embodiment, the first level shift register set $SR_1$ further receives a threshold driving signal STVP. Hence, the shift register sets $SR_1$, $SR_2$, $SR_3$, . . . , $SR_{n-2}$, $SR_{n-1}$, $SR_n$ respectively output the gate driving signals $Gout_1$, $Gout_2$, $Gout_3$, . . . , $Gout_{n-2}$, $Gout_{n-1}$, $Gout_n$ sequentially according to the threshold driving signal STVP, the gate timing signal CKV, and the inverted gate timing signal CKVB, so as to drive scan lines $GL_1$, $GL_2$, $GL_3$, . . . , $GL_{n-2}$, $GL_{n-1}$, $GL_n$ in sequence.

However, in other embodiments, the threshold signal STVP can also be received by the last level shift register set $SR_n$. Therefore, the gate driving signal $Gout_n$ is outputted from the shift register set $SR_n$ and the shift register sets $SR_{n-1}$, $SR_{n-2}$, . . . , $SR_3$, $SR_2$, $SR_1$ output the gate driving signals $Gout_{n-1}$, $Gout_{n-2}$, . . . , $Gout_3$, $Gout_2$, $Gout_1$ sequentially, so as to drive the scan lines $GL_{n-1}$, $GL_{n-2}$, . . . , $GL_3$, $GL_2$, $GL_1$ in sequence.

Moreover, the shift register sets $SR_1$, $SR_2$, $SR_3$, . . . , $SR_{n-2}$, $SR_{n-1}$, $SR_n$ of the present embodiment receive a gate controlling signal OXDON respectively. It should be noted that in the present embodiment, the shift register sets the $SR_1$, $SR_2$, $SR_3$, . . . , $SR_{n-2}$, $SR_{n-1}$, $SR_n$ receive the gate controlling signal OXDON respectively to improve the image sticking phenomenon.

Figure 2C:
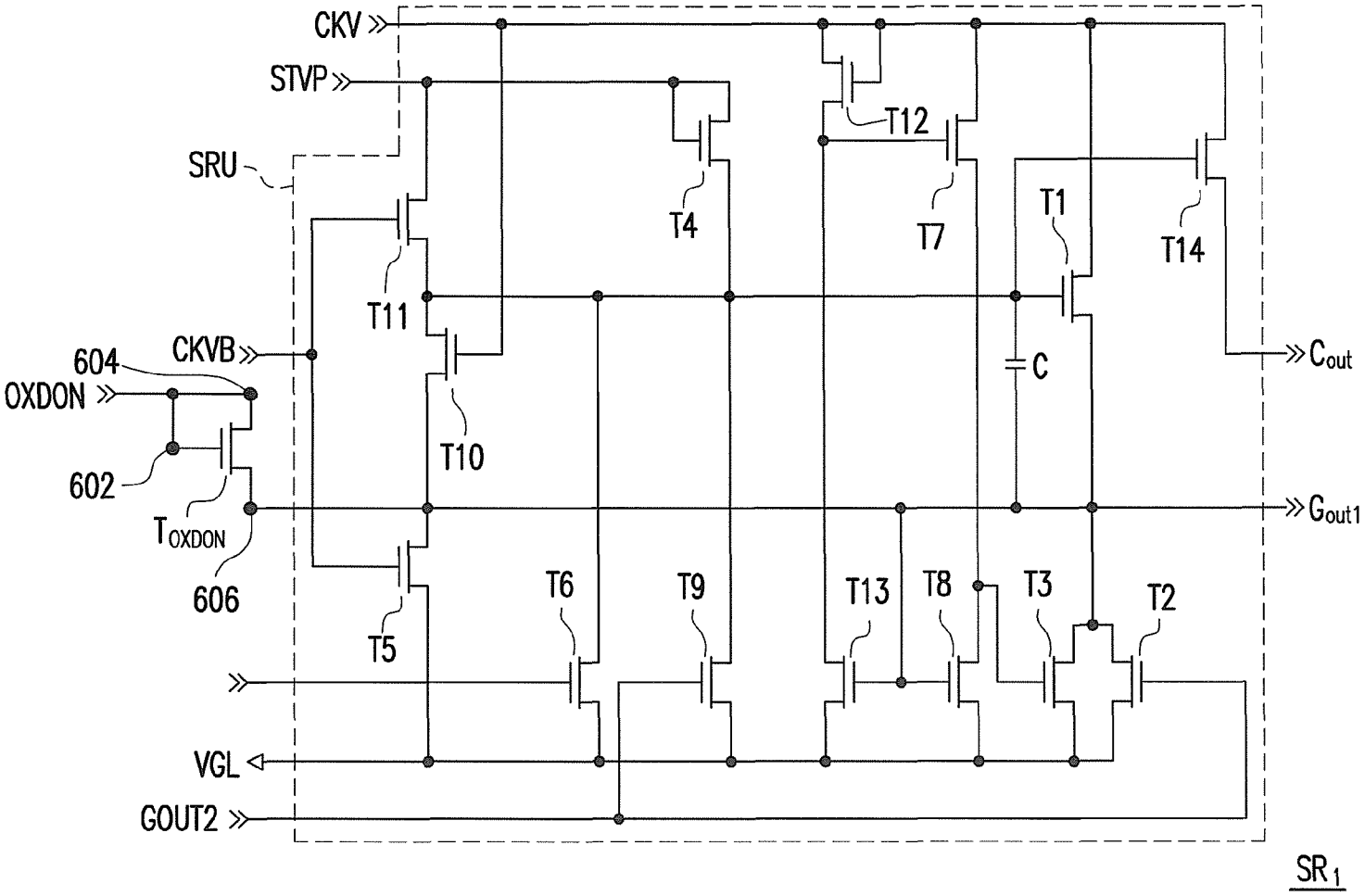
FIG. 2C is an equivalent circuit diagram of a single level shift register set in FIG. 2B.

FIG. 2C is an equivalent circuit diagram of a single level shift register set in FIG. 2B. It should be noted that the shift register set $SR_1$ illustrated in FIG. 2C is mainly configured to exemplify an approximate construction of a single level shift register set. Moreover, approximate constructions of other shift register sets such as $SR_2$, $SR_3$, . . . , $SR_{n-2}$, $SR_{n-1}$, $SR_n$ can refer to that of the shift register set $SR_1$. However, the invention does not limit the possibility for the shift register sets $SR_1$, $SR_2$, $SR_3$, . . . , $SR_{n-2}$, $SR_{n-1}$, $SR_n$ to possess a certain level of differentiation due to the consideration of actual products. In other words, the invention does not limit the shift register sets $SR_1$, $SR_2$, $SR_3$, . . . , $SR_{n-2}$, $SR_{n-1}$, $SR_n$ to be exactly the same.

Referring to FIG. 2C, the shift register set $SR_1$ of the present embodiment includes a shift register unit SRU and a transistor $T_{OXDON}$ coupled to the shift register unit SRU. In the present embodiment, the shift register set $SR_1$ is, for example, constituted by fourteen transistors T1~T14 and a capacitance C. Further, a gate 602 of the transistor $T_{OXDON}$ is coupled to a source/drain 604 and receives a gate controlling signal OXDON. A source/drain 606 is coupled to one of the source/drain of the transistor T5 and gates of the transistors T13 and T8. Here, the other source/drain and a gate of the transistor T5 receive the reference voltage VGL and the inverted gate timing signal CKVB respectively.

As aforementioned, the gate and one of the source/drain of the transistor T11 receive the inverted gate timing signal CKVB and the threshold driving signal STVP respectively. Moreover, the other source/drain thereof is coupled to one of the source/drain of each of the transistors T10, T6, T9, T4 and the gates of the transistors T1, T14. Here, the other source/drain of each of the transistors T6, T9 receive the reference voltage VGL. The gate and the other source/drain of the transistor T4 are coupled to receive the threshold driving signal STVP. The other source/drain of the transistor T10 is coupled to the source/drain 606 of the transistor $T_{OXDON}$, and the gate thereof receives the gate timing signal CKV. One of the source/drain of each of the transistors T1, T12, T7, T14 receive the gate timing signal CKV. Here, the gate of the transistor T12 also receives the gate timing signal CKV. The other source/drain of each of the transistors T1, T12, T7, T14, the gate of the transistor T7, and one of the source/drain of the transistor T13 are coupled to one another. The other source/drain of the transistor T7 is coupled to one of the source/drain of the transistor T8 and the gate of the transistor T3. The other source/drain of each of the transistors T8, T13 are coupled to each other to receive the reference voltage VGL. The other source/drain of the transistor T1 is coupled to one of the source/drain of each of the transistors T3, T2. Here, the other source/drain of the transistor T1 and the source/drain 606 of the transistor $T_{OXDON}$ are coupled to each other. Moreover, a capacitance C is disposed between the other source/drain and the gate of the transistor T1.

In the present embodiment, the gate 602 and the source/drain 604 of the transistor $T_{OXDON}$ are coupled to each other to form a diode. Hence, when the gate controlling signal OXDON received by the transistor $T_{OXDON}$ is a high level pulse signal and the driving signal STVP, the gate timing signal CKV, and the inverted gate timing signal CKVB are all low level voltage signals, the source/drain 606 of the transistor $T_{OXDON}$ outputs a high level gate driving signal $Gout_1$ by coupling to the shift register unit SRU and the gate driving signal $Gout_1$ is transmitted to the scan line $GL_1$.

More specifically, referring to FIGS. 2A-2C simultaneously, when the shift register sets $SR_1, SR_2, SR_3, \ldots, SR_{n-2}, SR_{n-1}, SR_n$ respectively receive the high level gate controlling signal OXDON and the low level driving signal STVP, the gate timing signal CKV, and the inverted gate timing signal CKVB, the shift register sets $SR_1, SR_2, SR_3, \ldots, SR_{n-2}, SR_{n-1}, SR_n$ outputs high level gate driving signals $Gout_1, Gout_2, Gout_3, \ldots, Gout_{n-2}, Gout_{n-1}, Gout_n$ respectively. Next, the high level gate driving signals $Gout_1, Gout_2, Gout_3, \ldots, Gout_{n-2}, Gout_{n-1}, Gout_n$ are transmitted to the pixel array 500 via the scan lines $GL_1, GL_2, GL_3, \ldots, GL_{n-2}, GL_{n-1}, GL_n$ so that every transistor in the pixel array 500 is turned on.

Consequently, when the display panel 200 has stopped displaying, through the gate controlling signal OXDON having the pulse signal, the gates of the transistors in the pixel array 500 correspondingly connected to the shift register sets $SR_1, SR_2, SR_3, \ldots, SR_{n-2}, SR_{n-1}, SR_n$ in the gate driving circuit 300 are conducted simultaneously according to this pulse signal. At the time, the pixel array 500 receives the source driving signal $Sout_i$ so as to update the display frame.

Figure 2D:
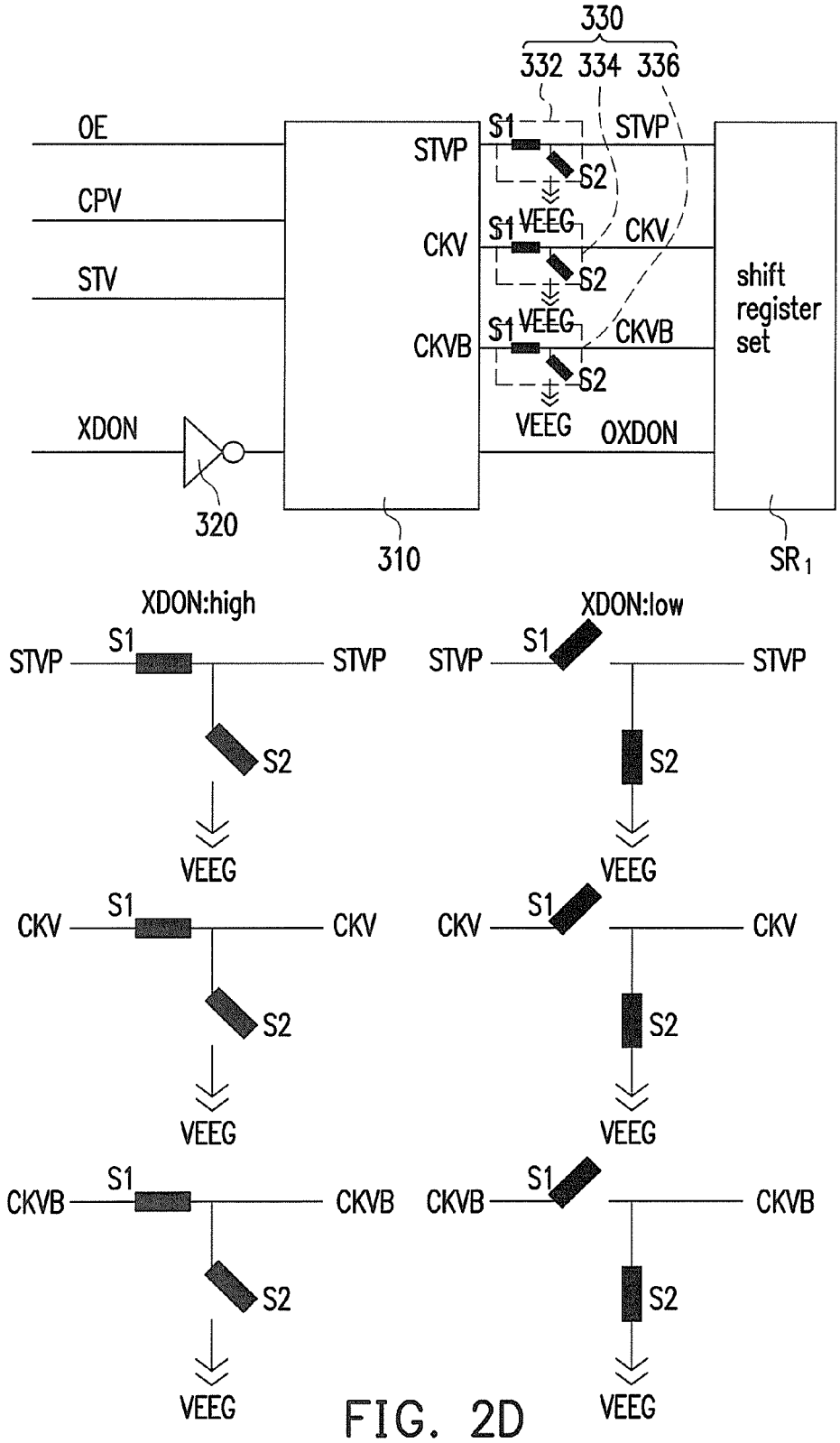
FIG. 2D is a block diagram illustrating a relationship between the single level shift register set, a level shift unit, and an inverter of an embodiment.

In the present embodiment, the gate controlling signal OXDON, the gate timing signal CKV, the inverted gate timing signal CKVB, and the driving signal STVP are provided by a level shift unit 310 illustrated in FIG. 2D. In the present embodiment, inputs of the shift register sets $SR_1, SR_2, SR_3, \ldots, SR_{n-2}, SR_{n-1}, SR_n$ are all coupled to an output of the level shift unit 310, so that the shift register sets $SR_1, SR_2, SR_3, \ldots, SR_{n-2}, SR_{n-1}, SR_n$ respectively receive the gate timing signal CKV, the inverted gate timing signal CKVB, the threshold driving signal STVP, and the gate controlling signal OXDON that are required.

In details, the level shift unit 310 of the present embodiment receives an output enable signal OE, a timing signal CPV, a threshold signal STV and a controlling signal XDON. Here, the level shift unit 310 converts the voltage level of the timing signal CPV to output the gate timing signal CKV and the inverted gate timing signal CKVB, converts the voltage level of the threshold signal STV to output the threshold driving signal STVP, and converts the voltage level of the controlling signal XDON to output the gate controlling signal OXDON. In the present embodiment, the conversion of voltage level, for example, is performed through the inverter 320 coupled to the level shift unit 310.

In addition, a plurality of adjustment units 330 is further disposed between paths of the level shift unit 310 and the shift register sets $SR_1, SR_2, SR_3, \ldots, SR_{n-2}, SR_{n-1}, SR_n$. Here, the adjustment units 330 each includes a plurality of switch sets 332, 334, and 336. The switch sets 332, 334, and 336 can all be constituted by a first switch S1 and a second switch S2 having opposite disenable/enable actions.

In details, the first switch S1 of the present embodiment is serially connected between the level shift unit 310 and the shift register sets $SR_1, SR_2, SR_3, \ldots, SR_{n-2}, SR_{n-1}, SR_n$. The second switch S2 is serially connected between the level shift unit 310, the shift register sets $SR_1, SR_2, SR_3, \ldots, SR_{n-2}, SR_{n-1}, SR_n$, and another reference voltage VEEG. In the present embodiment, the reference voltage VEEG is a low level voltage, for example. In practice, potentials of the reference voltage VEEG and the reference voltage VGL can be identical. Obviously, the invention is not limited thereto.

In the present embodiment, the switch sets 332, 334, and 336 respectively receive the threshold driving signal STVP, the gate timing signal CKV, and the inverted gate timing signal CKVB outputted by the level shift unit 310. Since the first switch S1 and the second switch S2 have opposite disenable/enable actions, when the first switch S1 is enabled and the second switch S2 is disenabled, the threshold driving signal STVP, the gate timing signal CKV, and the inverted gate timing signal CKVB transmitted to the shift register sets $SR_1, SR_2, SR_3, \ldots, SR_{n-2}, SR_{n-1}, SR_n$ are the voltage levels outputted by the level shift unit 310.

Alternatively, when the first switch S1 is disenabled and the second switch S2 is enabled, the threshold driving signal STVP, the gate timing signal CKV, and the inverted gate timing signal CKVB transmitted to the shift register sets $SR_1, SR_2, SR_3, \ldots, SR_{n-2}, SR_{n-1}, SR_n$ are converted to the level of the reference voltage VEEG.

Figure 3:
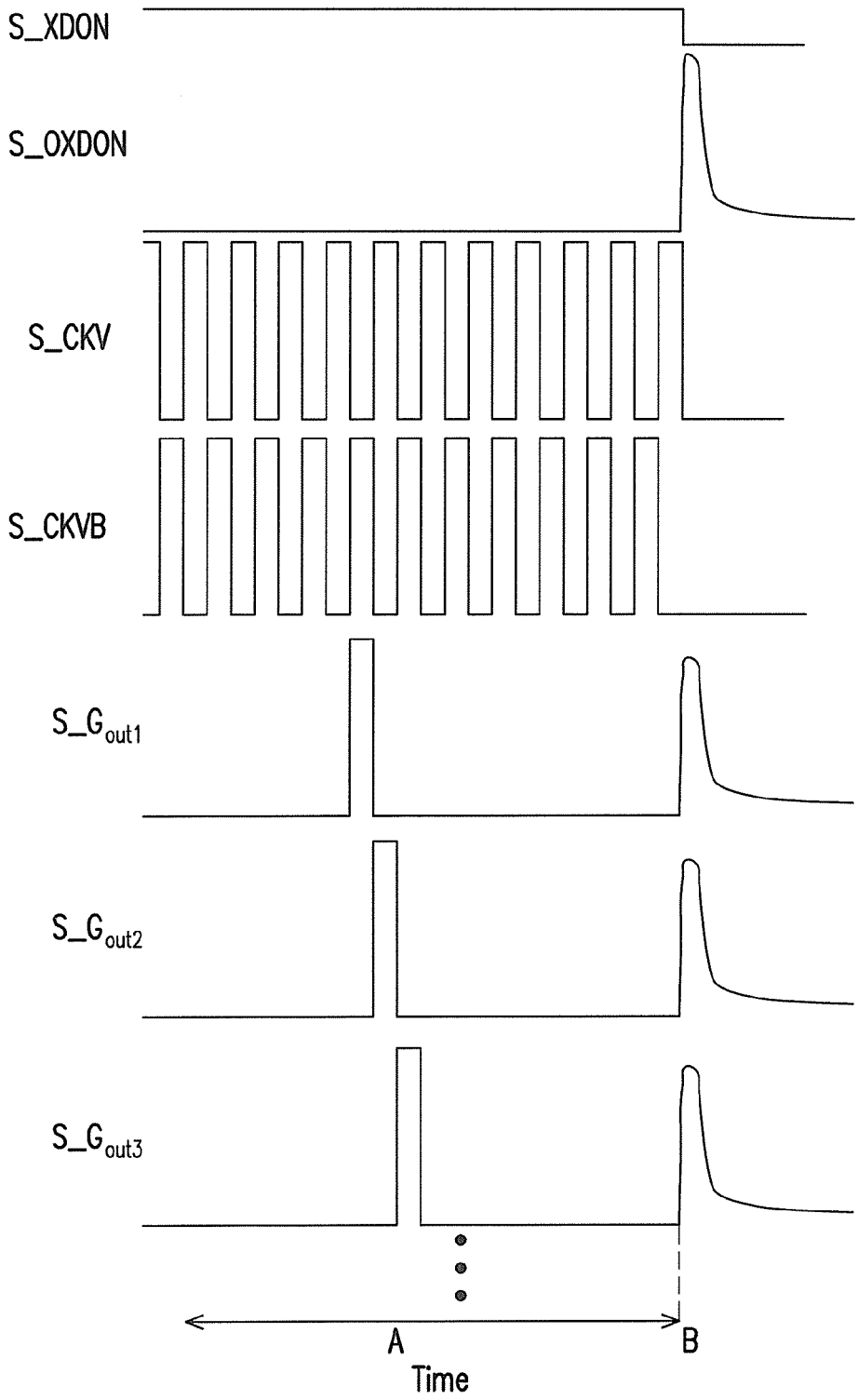
FIG. 3 shows a driving waveform of a display panel according to an embodiment of the invention.

In view of the above-mentioned, a perspective of the signal waveform is adopted for illustration. FIG. 3 shows a driving waveform of a display panel according to an embodiment of the invention. Here, S_XDON, S_OXDON, S_CKV, S_CKVB represent waveforms of the inverted controlling signal XDON, the gate controlling signal OXDON, the gate timing signal CKV, the inverted gate timing signal CKVB respectively. Moreover, $S_Gout_1$, $S_Gout_2$, $S_Gout_3$, . . . represent waveforms of the gate driving signals $Gout_1$, $Gout_2$, $Gout_3$, . . . respectively.

Referring to FIG. 3, the display panel 200 displays within a time A period, and the inverted controlling signal XDON is a pulse signal having high level voltage, so that the gate controlling signal OXDON has low level voltage. Additionally, the first and the second switches S1, S2 in the switch sets 332, 334, and 336 are in an enabled state and a disenabled state respectively. Therefore, the scan lines $GL_1$, $GL_2$, $GL_3$, . . . , $GL_{n-2}$, $GL_{n-1}$, $GL_n$ obtain the gate driving signals $Gout_1$, $Gout_2$, $Gout_3$, . . . , $Gout_{n-2}$, $Gout_{n-1}$, $Gout_n$ required for displaying via the shift register sets $SR_1$, $SR_2$, $SR_3$, . . . , $SR_{n-2}$, $SR_{n-1}$, $SR_n$.

On the other hand, at a moment of time B, the display panel 200 stops displaying, and the inverted controlling signal XDON is a pulse signal having a low level voltage, so that the gate controlling signal OXDON is a pulse signal having a high level voltage. Furthermore, the first and the second switches S1, S2 in the switch sets 332, 334, and 336 are on the disenabled state and the enabled state respectively, such that the voltage levels of threshold driving signal STVP, the gate timing signal CKV, and the inverted gate timing signal CKVB equal the voltage level of the reference voltage VEEG.

As aforementioned, through the gate controlling signal OXDON of high level and the threshold driving signal STVP, the gate timing signal CKV, and the inverted gate timing signal CKVB of low levels, the shift register sets $SR_1$, $SR_2$, $SR_3$, . . . , $SR_{n-2}$, $SR_{n-1}$, $SR_n$ output the gate driving signals $Gout_1$, $Gout_2$, $Gout_3$, . . . , $Gout_{n-2}$, $Gout_{n-1}$, $Gout_n$ of high level, so that the gates of the transistors in the pixel region P are conducted simultaneously. At this time, the source driving signal $Sout_i$ is applied to every pixel region P, so that the display panel can update the frame, thereby solving the problem of image sticking.

In summary, the gate driving circuit of the display panel of the invention eliminates the image sticking phenomenon. Here, each shift register set in the gate driving circuit adopts the shift register unit and the transistor coupled to one another for driving the scan lines at the moment of turning off the display panel. Hence, the display panel is capable of displaying an expected image when being turned off, thereby eliminating the image sticking phenomenon.

Although the invention has been described with reference to the embodiments thereof, it will be apparent to one of the ordinary skills in the art that modifications to the described embodiments may be made without departing from the spirit of the invention. Accordingly, the scope of the invention will be defined by the attached claims not by the above detailed description.

What is claimed is:

1. A gate driving circuit of a display panel, comprising:

a plurality of shift register sets, each shift register set comprising a shift register unit and a transistor, wherein the shift register units are coupled to one another in series and receive a gate timing signal and an inverted gate timing signal, one of a first level shift register unit and a last level shift register unit further receives a threshold driving signal, and the shift register units respectively output a plurality of gate driving signals sequentially according to the threshold driving signal, the gate timing signal, and the inverted gate timing signal, the transistors are coupled to the shift register units respectively, wherein a gate and a first source/drain of each transistor are coupled to receive a gate controlling signal, a second source/drain of each transistor is coupled to a corresponding shift register unit to output one of the gate driving signals, wherein when the display panel has stopped displaying, the gate controlling signal is a pulse signal, so that a plurality of gates connected correspondingly to the shift register units in the gate driving circuit of the display panel are conducted simultaneously according to this pulse signal;

a plurality of level shift units, coupled to the shift register sets respectively and receiving an output enable signal, a timing signal, a threshold signal, and a controlling signal, wherein each level shift unit converts a voltage level of the timing signal to output the gate timing signal and the inverted gate timing signal, each level shift unit converts a voltage level of the threshold signal to output the threshold driving signal, and each level shift unit converts a voltage level of the controlling signal to output the gate controlling signal; and a plurality of adjustment units, serially connected between paths of the level shift units coupling to the shift register sets respectively, the adjustment units transmits the gate timing signal, the inverted gate timing signal and the threshold driving signal to the shift register sets before the pulse signal of the gate controlling signal is formed, and the adjustment units transmits a reference voltage to the shift register sets when the pulse signal of the gate controlling signal is formed.

2. The gate driving circuit of the display panel as claimed in claim 1, wherein each adjustment unit comprises:

a plurality of switch sets, receiving the threshold driving signal, the gate timing signal, and the inverted gate timing signal, and each switch set comprising:

a first switch, serially connected between a corresponding level shift unit and a corresponding shift register set; and a second switch, serially connected between the reference voltage, the corresponding level shift unit, and the corresponding shift register set, wherein the first switch and the second switch have opposite disenable/enable actions.

3. The gate driving circuit of the display panel as claimed in claim 1, further comprising:

a plurality of inverters, coupled to the level shift units respectively, wherein each inverter receives an inverted controlling signal to output the controlling signal accordingly.

4. The gate driving circuit of the display panel as claimed in claim 1, wherein the inverted gate timing signal is an inverse of the gate timing signal.

* * * * *